United States Patent [19]

Buzzi

[11] Patent Number: 4,516,933

[45] Date of Patent: May 14, 1985

[54] HOUSEHOLD LIGHTER

[76] Inventor: Enrico Buzzi, Via Europa 120, Concesio (Province of Brescia), Italy

[21] Appl. No.: 612,232

[22] Filed: May 21, 1984

[30] Foreign Application Priority Data

Nov. 11, 1983 [IT] Italy ..... 23530/83[U]

[51] Int. Cl.[3] ..... F23Q 7/12

[52] U.S. Cl. ..... 431/255; 431/142

[58] Field of Search ..... 431/255, 345, 142, 143, 431/274, 276, 277, 130, 131

[56] References Cited

U.S. PATENT DOCUMENTS

| | | | |
|---|---|---|---|
| 4,253,818 | 3/1981 | Ogawa et al. | 431/274 |
| 4,292,021 | 9/1981 | Miyagawa | 431/255 |
| 4,457,697 | 7/1984 | Kitabayashi | 431/277 |

FOREIGN PATENT DOCUMENTS

| | | | |
|---|---|---|---|
| 83451 | 2/1977 | Australia | 431/255 |

*Primary Examiner*—Carroll B. Dority, Jr.

*Attorney, Agent, or Firm*—Guido Modiano; Albert Josif

[57] ABSTRACT

A household lighter comprises an outer housing formed by two half-shells and accommodating a piezoelectric cartridge and an actuation pushbutton, a gas supply reservoir forming the lighter handle and a block connecting the outer housing and the handle. The block has a projecting flange at a lateral surface thereof so as to define a first portion fitting within wall ends of the reservoir and a second portion clamped between the two half-shells of the outer housing. The block is also provided with engagement members allowing a firm connection between the parts.

6 Claims, 9 Drawing Figures

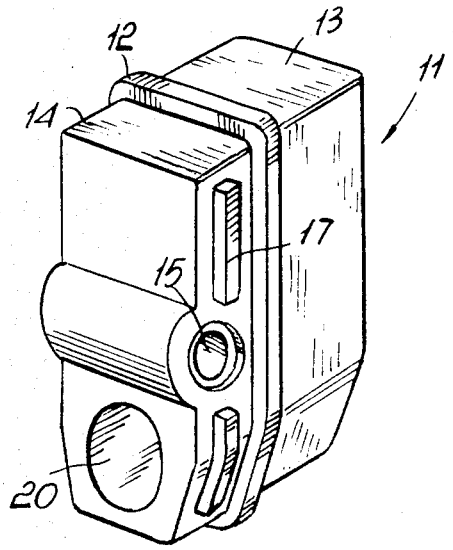
Fig. 2
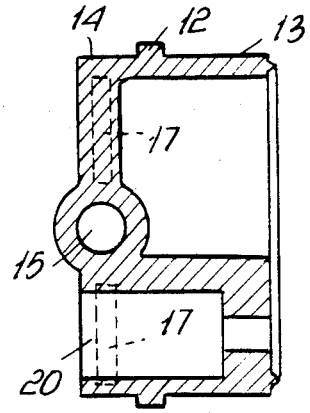
Fig. 7
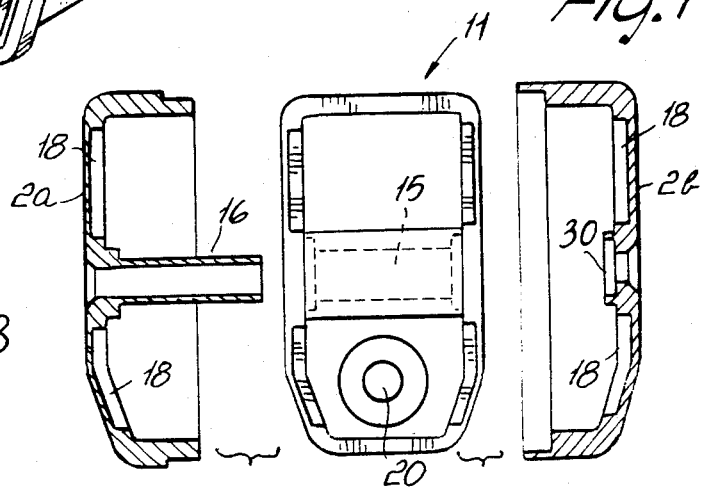
Fig. 8
Fig. 9
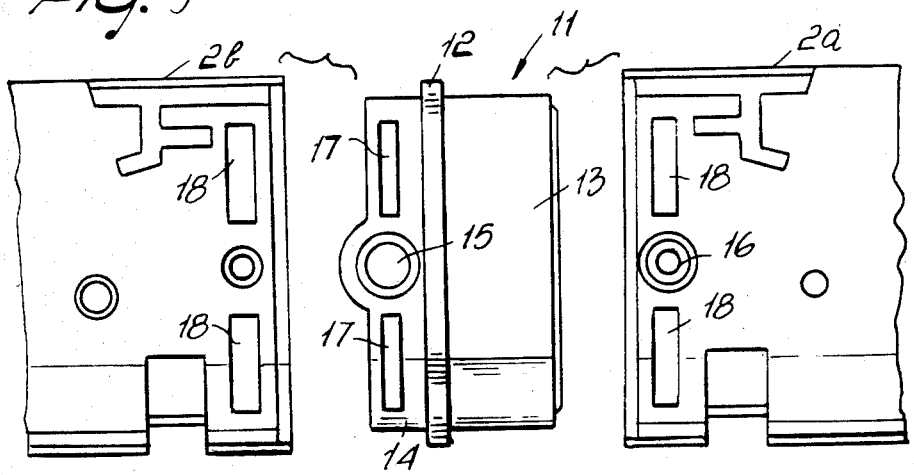

HOUSEHOLD LIGHTER

BACKGROUND OF THE INVENTION

This invention relates to a household lighter structure.

As is known, household lighters are presently available on the market which, additionally to generating a spark through a piezoelectric cartridge or the like means, can also issue a continuous flame which is fed with liquefied gas from a container defined within the lighter.

In such prior lighter structures, the gas container comprises a reservoir accommodated inside a box-like housing of the lighter, which poses problems of operation autonomy if the lighter is not to be manufactured in excessively large sizes or sizes that would make the lighter unwieldy to use.

SUMMARY OF THE INVENTION

It is an object of this invention to obviate such prior disadvantages by providing a household lighter structure incorporating a liquefied gas reservoir, which affords the possibility of fitting a relatively large capacity reservoir therein without unduly increasing the lighter overall size.

A further object of the invention is to provide a lighter structure which involves a simplified assembling procedure, and requires a relatively small number of component parts.

It is another object of this invention to provide a lighter structure the various component parts whereof are arranged to produce an apparatus which is highly reliable and practical to use.

Still another object of the invention is to provide a lighter structure which can be easily manufactured from commercially readily available materials and be highly competitive from the purely economical standpoint.

These and other objects, such as will be apparent hereinafter, are achieved by a household lighter structure, according to the invention, comprising an outer housing containing a spark generating cartridge for operation by a pushbutton barely protruding from said housing, characterized in that it comprises a liquefied gas supply reservoir forming the handle of said lighter and being closed at one end by a small block constituting the connective element to said box-like housing.

BRIEF DESCRIPTION OF THE DRAWINGS

Further features and advantages will be more readily understood from the following detailed description of a household lighter structure, as illustrated by way of example only in the accompanying drawings, where:

FIG. 2 is a perspective view of the connective block between the box-like housing and gas supply reservoir;

FIG. 7 is a sectional view of the block taken in a longitudinal plane thereof;

FIG. 8 is an exploded view of the connection of the block to half-shells making up the box-like housing; and FIG. 9 shows the block and half-shells in an open condition to provide an improved view of their configurations.

DESCRIPTION OF THE PREFERRED EMBODIMENTS

Figure 1:
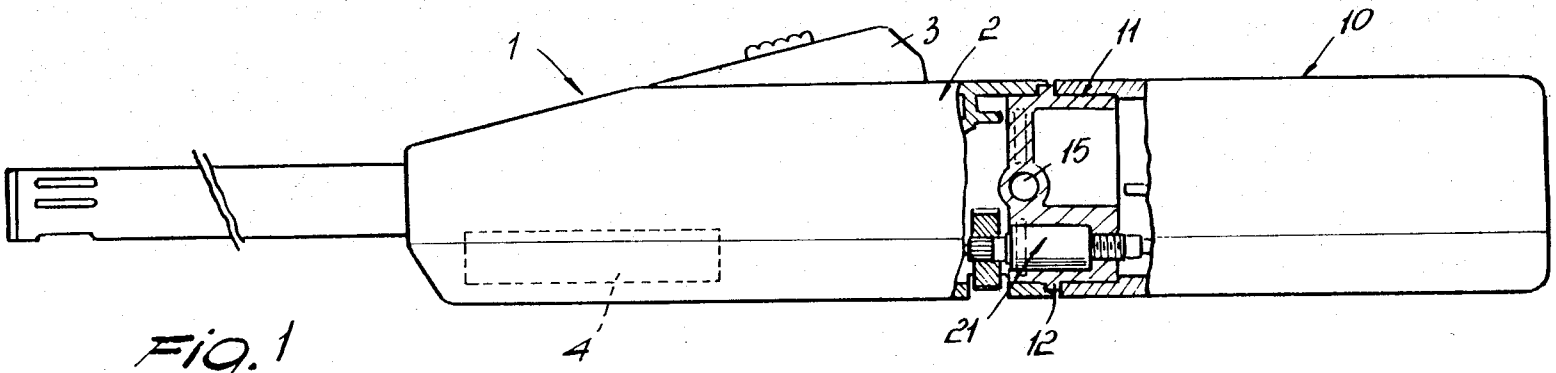
FIG. 1 is a partly cut-away view of the household lighter structure according to the invention.
Figure 3:
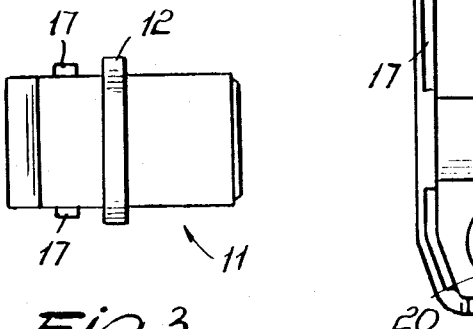
FIGS. 3, 4, 5 and 6 are top, front, side, and rear views, respectively, of the cited block.
Figure 4:
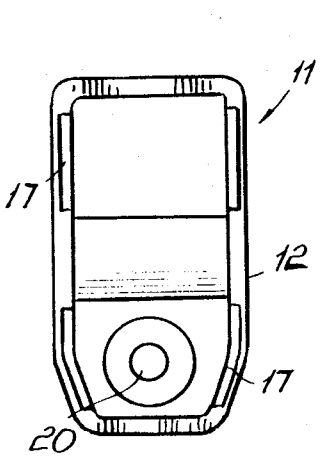
Figure 5:
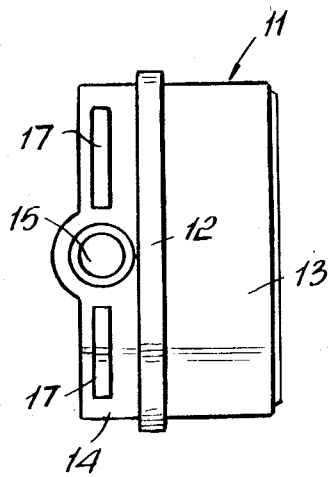
Figure 6:
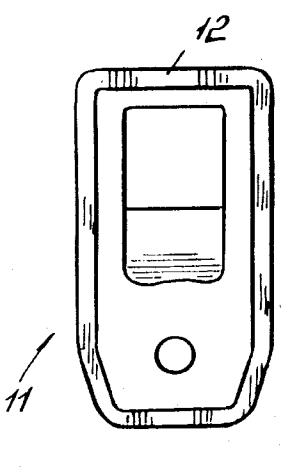

With reference to the drawing views, this household lighter structure, generally indicated at 1, comprises an outer housing 2 which is advantageously formed by two half-shells, respectively indicated at 2*a* and 2*b*, which can be coupled together.

Accommodated within the housing 2 is a conventional piezoelectric cartridge 4 operative to generate a spark by means of a pushbutton 3 which stands barely out of the top portion of the housing 2.

A peculiar aspect of the invention is that the lighter comprises a liquefied gas supply reservoir, generally designated with the reference numeral 10, which forms in practice the lighter handle, thus affording the possibility of making the reservoir relatively large without increasing the lighter overall size excessively.

The reservoir 10 has an elongate configuration closed at the rear end, where a gas filler valve is provided, and open at the front.

The reservoir 10 is closed at the front by a small block 11 which also forms a connective element for attachment to the box-like housing.

More in detail, the block 11, which has an approximately parallelepipedal shape, defines on its lateral surface a projecting flange 12 which divides said lateral surface into a first portion 13, adapted for fitting into and connecting as by welding or cementing to the inside of the wall ends of the reservoir 10, and a second portion 14 which is practically clamped between the ends of the two half-shells 2*a* and 2*b*.

To provide a firm fit in the housing 2, the portion 14 has a hole 15 across it, wherethrough a pin 16 is passed which is formed integrally with the half-shell 2*a*. During the mounting of the lighter, the end of the pin 16 abuts against the half-shell 2*b* and arranges in a seat 30 provided therein. Thereafter the end of the pin and the seat are welded, for example by means of the ultrasonic technique. Furthermore the portion 14 has projecting wings 17 adapted to fit into receptacles 18 correspondingly formed on the inside walls of the half-shells 2*a* and 2*b*.

The block is also formed with a throughgoing cavity 20, for accommodating delivery valve means 21 intended to supply gas outwardly.

It may be appreciated from the foregoing description how the household lighter structure of this invention is specially practical to use, since the reservoir forms itself the lighter handle and affords, accordingly, a large capacity for gas within relatively small overall dimensions of the lighter, while the block 11 arranged to close the reservoir also forms an element of connection between the reservoir and box-like housing.

Furthermore, the interlocking elements provided, namely, the wings 17, receptacles 18, and cross hole 15 and pin 16, all combine to make the assembling of the lighter quite rapid, thus bringing about inherent economical advantages.

In practicing the invention, the materials used, provided that they are compatible with the intended application, as well as the dimensions and contingent shapes, may be any selected ones to meet individual requirements.

I claim:

1. A household lighter comprising an outer housing containing a spark generating cartridge for operation by a pushbutton barely protruding from said housing, characterized in that it comprises a liquefied gas supply reservoir forming a handle for the lighter and being closed at one end by a small block constituting a connective element to said outer housing.

2. A household lighter, according to claim 1, characterized in that said outer housing includes two half-shells arranged for mutual coupling and connection to said block.

3. A household lighter, according to claim 1, characterized in that said block has a substantially parallelepipedal configuration with a projecting flange at a lateral surface thereof and defining, on said lateral surface, a first portion fitting within wall ends of said reservoir, and a second portion clamped between half-shells constituting said outer housing.

4. A household lighter, according to claim 3, characterized in that a hole is provided across and transverse to said second portion for engagement by a pin formed integrally with either of said half-shells.

5. A household lighter, according to claim 3, characterized in that it comprises, on said second portion of said block, projecting wings fitting in recesses correspondingly formed on the inside of said half-shells.

6. A household lighter, according to claim 1, characterized in that it comprises a throughgoing cavity in said block for accommodating gas delivery valve means operative to deliver gas from said gas supply reservoir.

* * * * *